US011125478B2

(12) United States Patent
Yanachi et al.

(10) Patent No.: US 11,125,478 B2
(45) Date of Patent: Sep. 21, 2021

(54) AIR CONDITIONING SYSTEM

(71) Applicant: Mitsubishi Electric Corporation, Tokyo (JP)

(72) Inventors: Satoru Yanachi, Tokyo (JP); So Nomoto, Tokyo (JP); Takuya Matsuda, Tokyo (JP); Naofumi Takenaka, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/964,759

(22) PCT Filed: Feb. 26, 2018

(86) PCT No.: PCT/JP2018/006996
§ 371 (c)(1),
(2) Date: Jul. 24, 2020

(87) PCT Pub. No.: WO2019/163132
PCT Pub. Date: Aug. 29, 2019

(65) Prior Publication Data

US 2020/0355415 A1 Nov. 12, 2020

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... F25B 41/20; F25B 13/00; F24F 2110/10; F24F 2120/10; F24F 2120/14; F24F 2120/12; F24F 2140/50
See application file for complete search history.

(56) References Cited

U.S. PATENT DOCUMENTS

2016/0305678 A1 10/2016 Pavlovski et al.

FOREIGN PATENT DOCUMENTS

| | | | | |
|---|---|---|---|---|
| DE | 102014224489 | A1 | | 6/2016 |
| JP | 2005-180770 | A | | 7/2005 |
| JP | 2005180770 | A | * | 7/2005 |
| JP | 2005-207696 | A | | 8/2005 |
| JP | 2005207696 | A | * | 8/2005 |
| JP | 2007-285542 | A | | 11/2007 |

(Continued)

OTHER PUBLICATIONS

JP-2005207696-A Translation (Year: 2005).*

(Continued)

*Primary Examiner* — Marc E Norman
*Assistant Examiner* — Schyler S Sanks
(74) *Attorney, Agent, or Firm* — Posz Law Group, PLC

(57) ABSTRACT

An air conditioning system includes: a plurality of indoor units each configured to condition air in a target space; and an outdoor unit connected to the plurality of indoor units. Each of the plurality of indoor units has a surface temperature measuring device configured to measure a surface temperature of an object in the target space. When a total of capacities requested by the plurality of indoor units is larger than a capacity of the outdoor unit, each of the plurality of indoor units performs a process corresponding to a change amount of the surface temperature per unit time.

5 Claims, 8 Drawing Sheets

(56) References Cited

FOREIGN PATENT DOCUMENTS

| | | | | | |
|---|---|---|---|---|---|
| JP | 2008-232562 | A | | 10/2008 | |
| JP | 2008-256260 | A | | 10/2008 | |
| JP | 2008256260 | A | * | 10/2008 | |
| JP | 2012-225550 | A | | 11/2012 | |
| JP | 2012-225586 | A | | 11/2012 | |
| JP | 2012225586 | A | * | 11/2012 | |
| JP | 2014-219152 | A | | 11/2014 | |
| JP | 2015-029382 | A | | 2/2015 | |
| JP | 2017-101881 | A | | 6/2017 | |
| WO | WO-2016087116 | A1 | * | 6/2016 | ..... F24F 11/62 |

OTHER PUBLICATIONS

JP-2012225586-A Translation (Year: 2012).*
JP-2005180770-A Translation (Year: 2005).*
JP-2008256260-A Translation (Year: 2008).*
Translation of WO2016087116A1 (Year: 2016).*
International Search Report of the International Searching Authority dated Apr. 24, 2018 for the corresponding international application No. PCT/JP2018/006996 (and English translation).
Extended European Search Report dated Feb. 2, 2021 issued in corresponding EP patent application No. 18907397.6.

* cited by examiner

| | CHANGE AMOUNT OF SURFACE TEMPERATURE OF OBJECT PER UNIT TIME | PRIORITY |
|---|---|---|
| INDOOR UNIT 2a | 0.1 (HEAT CAPACITY: LARGE) | 3 |
| INDOOR UNIT 2b | 0.5 (HEAT CAPACITY: SMALL) | 1 |
| INDOOR UNIT 2c | 0.3 (HEAT CAPACITY: MEDIUM) | 2 |

| | NUMBER OF PEOPLE IN TARGET SPACE | CHANGE AMOUNT OF SURFACE TEMPERATURE OF OBJECT PER UNIT TIME | PRIORITY |
|---|---|---|---|
| INDOOR UNIT 2a | 5 | 0.1 (HEAT CAPACITY: LARGE) | 1 |
| INDOOR UNIT 2b | 2 | 0.5 (HEAT CAPACITY: SMALL) | 2 |
| INDOOR UNIT 2c | 2 | 0.3 (HEAT CAPACITY: MEDIUM) | 3 |

AIR CONDITIONING SYSTEM

CROSS REFERENCE TO RELATED APPLICATION

This application is a U.S. national stage application of PCT/JP2018/006996 filed on Feb. 26, 2018, the contents of which are incorporated herein by reference.

TECHNICAL FIELD

The present disclosure relates to an air conditioning system including a plurality of indoor units.

BACKGROUND ART

There has been conventionally known an air conditioning system including a refrigerant circuit in which an outdoor unit and a plurality of indoor units are connected using pipes, in order to condition air in each space of a construction such as, for example, a building. In such an air conditioning system, there may arise an insufficient capacity state in which a total of capacities requested by the plurality of indoor units is larger than a capacity of the outdoor unit. The insufficient capacity state arises, for example, at the time of simultaneous startup of the plurality of indoor units or at the time of return to the heating operation from the defrosting operation.

Japanese Patent Laying-Open No. 2008-232562 (PTL 1) discloses the technique of presetting priorities of a plurality of indoor units and stopping the operation of the indoor units in accordance with the priorities when an insufficient capacity state arises.

CITATION LIST

Patent Literature

PTL 1: Japanese Patent Laying-Open No. 2008-232562

SUMMARY OF INVENTION

Technical Problem

However, according to the technique described in Japanese Patent Laying-Open No. 2008-232562, a user needs to check a situation of a space where each of the indoor units is placed, and preset the priorities of the plurality of indoor units.

It is an object of the present disclosure to provide an air conditioning system in which each of a plurality of indoor units can automatically perform an operation corresponding to a situation of a space where each of the indoor units is placed, when an insufficient capacity state of an outdoor unit arises.

Solution to Problem

An air conditioning system according to an aspect of the present disclosure includes: a plurality of indoor units each configured to condition air in a target space; and an outdoor unit connected to the plurality of indoor units. Each of the plurality of indoor units has a surface temperature measuring device configured to measure a surface temperature of an object in the target space. When a total of capacities requested by the plurality of indoor units is larger than a capacity of the outdoor unit, each of the plurality of indoor units performs a process corresponding to a change amount of the surface temperature per unit time.

An air conditioning system according to an aspect of the present disclosure includes: a plurality of indoor units each configured to condition air in a target space; and an outdoor unit connected to the plurality of indoor units. Each of the plurality of indoor units has a camera configured to capture an image of the target space. It is determined whether or not the target space is a server room, based on the image captured by the camera. When a total of capacities requested by the plurality of indoor units is larger than a capacity of the outdoor unit, an indoor unit placed in the target space that is the server room, of the plurality of indoor units, is operated more preferentially.

Advantageous Effects of Invention

According to the present disclosure, each of the plurality of indoor units can automatically perform the process corresponding to the change amount of the surface temperature of the object in the target space per unit time. Alternatively, of the plurality of indoor units, an indoor unit placed in the target space that is the server room is automatically operated more preferentially. As a result, each of the plurality of indoor units can automatically perform the operation corresponding to the situation of the space where each of the indoor units is placed, when the insufficient capacity state of the outdoor unit arises.

DESCRIPTION OF EMBODIMENTS

Figure 1:
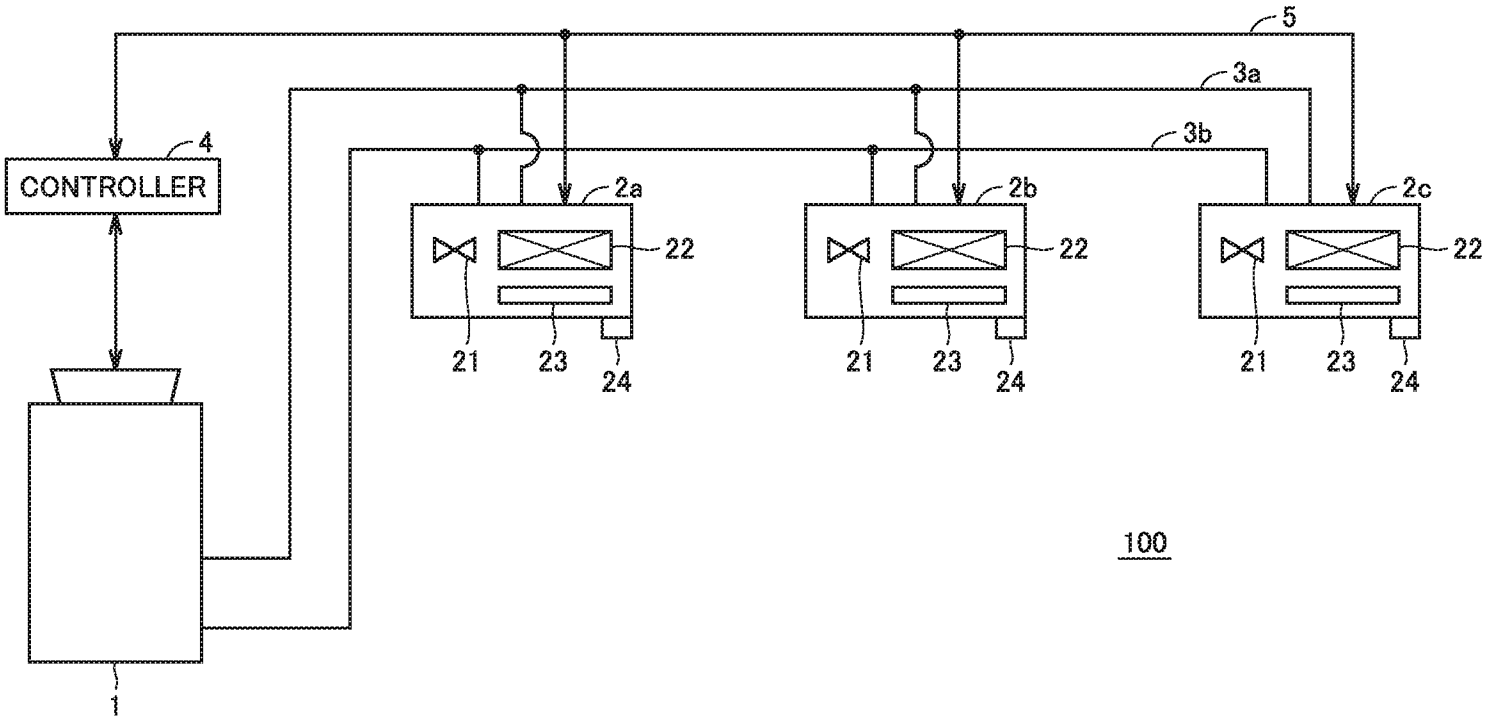
FIG. 1 is a schematic configuration diagram of an air conditioning system according to a first embodiment.

Hereinafter, embodiments of the present disclosure will be described in detail with reference to the drawings. While a plurality of embodiments will be described hereinafter, it is originally intended to combine the features described in the embodiments as appropriate. In the drawings, the same or corresponding portions are designated by the same reference characters, and the description thereof will not be repeated. Furthermore, the forms of the components illustrated in the whole description are merely examples, and the present disclosure is not limited to these descriptions.

First Embodiment (Configuration of Air Conditioning System)

FIG. 1 is a schematic configuration diagram of an air conditioning system according to a first embodiment. Referring to FIG. 1, an air conditioning system 100 includes an outdoor unit 1, indoor units 2*a* to 2*c*, pipes 3*a* and 3*b*, a controller 4, and a communication line 5. Each of indoor units 2*a* to 2*c* is connected in parallel to outdoor unit 1 by pipes 3*a* and 3*b*. In the following description, when a distinction among indoor units 2*a* to 2*c* is not particularly required, each of indoor units 2*a* to 2*c* is referred to as "indoor unit 2". The number of indoor units 2 is not limited to three, and may be two or four or more. Refrigerant serving as a heat medium is circulated through a circulation circuit formed by outdoor unit 1, pipe 3*a*, indoor unit 2, and pipe 3*b*. Controller 4 is connected to outdoor unit 1 and indoor unit 2 by communication line 5.

Outdoor unit 1 includes, for example, a compressor, an outdoor heat exchanger and the like, and delivers the refrigerant to indoor unit 2 to thereby provide a capacity (amount of heat) for indoor unit 2 to heat and cool a target space. Herein, a maximum capacity that can be provided to indoor units 2*a* to 2*c* by outdoor unit 1 is referred to as "outdoor unit capacity".

Indoor unit 2 conditions air in the target space such that a measured temperature of the air taken in from the target space where indoor unit 2 is placed becomes closer to a set room temperature, based on a signal provided from a not-shown remote controller including an operation start button, an operation stop button, a room temperature setting button and the like. Indoor unit 2 outputs the measured temperature of the air taken in from the target space and the set room temperature to controller 4 through communication line 5.

Indoor unit 2 includes a flow rate adjusting valve 21, an indoor heat exchanger 22, a fan 23, and a surface temperature measuring device 24. Flow rate adjusting valve 21 is a valve for adjusting a flow rate of the refrigerant from outdoor unit 1 to indoor heat exchanger 22. Indoor heat exchanger 22 performs heat exchange between the air in the target space and the refrigerant. Fan 23 delivers the air in the target space to indoor heat exchanger 22, Indoor unit 2 adjusts a degree of opening of flow rate adjusting valve 21 and an amount of air blown by fan 23 such that the measured temperature of the air taken in from the target space becomes closer to the set room temperature.

Surface temperature measuring device 24 detects a surface temperature of an object (such as, for example, a wall surface or furniture) in the target space where indoor unit 2 is placed. Surface temperature measuring device 24 is implemented by an infrared sensor. Surface temperature measuring device 24 outputs surface temperature information indicating the measured surface temperature to controller 4 through communication line 5.

When a total of capacities requested by indoor units 2*a* to 2*c* (hereinafter, referred to as "total requested capacity") is larger than the outdoor unit capacity, controller 4 controls an amount of distribution of the outdoor unit capacity among indoor units 2*a* to 2*c*. Controller 4 includes a storage device, an input/output buffer, and a central processing unit (CPU) that executes a program stored in the storage device using information input to the input/output buffer (all are not shown).

(Configuration of Controller)

Figure 2:
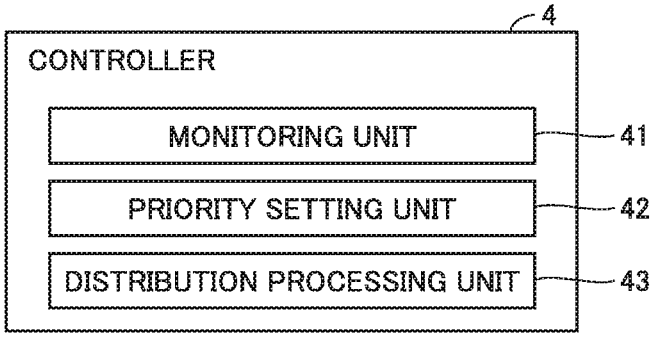
FIG. 2 is a block diagram showing a schematic configuration of a controller shown in FIG. 1.

FIG. 2 is a block diagram showing a schematic configuration of controller 4. Controller 4 includes a monitoring unit 41, a priority setting unit 42 and a distribution processing unit 43.

Monitoring unit 41 calculates a capacity (requested capacity) requested by indoor unit 2, based on a difference between the measured temperature and the set room temperature output from indoor unit 2. Monitoring unit 41 monitors the total of requested capacities (total requested capacity) calculated for indoor units 2*a* to 2*c*.

Priority setting unit 42 sets a priority of each of indoor units 2*a* to 2*c*. Priority setting unit 42 calculates a change amount of the surface temperature per unit time based on the surface temperature information output from each of indoor units 2*a* to 2*c*. Priority setting unit 42 sets the priority based on the change amount of the surface temperature per unit time. Specifically, priority setting unit 42 assigns a higher priority to indoor unit 2 including surface temperature measuring device 24 that detects a surface temperature having a larger change amount per unit time.

When the total requested capacity monitored by monitoring unit 41 is larger than the outdoor unit capacity, distribution processing unit 43 distributes the outdoor unit capacity among indoor units 2*a* to 2*c* in accordance with the priorities set for indoor units 2*a* to 2*c*. Distribution processing unit 43 distributes a smaller amount of the outdoor unit capacity to indoor unit 2 having a lower priority. For example, distribution processing unit 43 causes indoor unit 2 having a lower priority to set the degree of opening of flow rate adjusting valve 21 lower and/or the amount of air blown by fan 23 smaller.

The change amount of the surface temperature per unit time is a parameter indicating a heat capacity of the target space where indoor unit 2 is placed. A target space having a larger change amount of the surface temperature per unit time has a smaller heat capacity. When the heat capacity of the target space is small, the time required for the temperature of the target space to reach the set room temperature at the time of startup of indoor unit 2 is short. In contrast, when the heat capacity of the target space is large, the time required for the temperature of the target space to reach the set room temperature at the time of startup of indoor unit 2 is long. Therefore, by assigning a higher priority to indoor unit 2 placed in a target space having a smaller heat capacity, the temperature of the target space where indoor unit 2 is placed can reach the set room temperature in a short time. As a result, the capacity requested by this indoor unit 2 decreases, and thus, the amount of distribution of the outdoor unit capacity to the other indoor units 2 can be increased at an early stage.

Furthermore, when the operation is switched from the heating operation to the defrosting operation and then returned to the heating operation, a temperature change during the defrosting operation in a target space having a smaller heat capacity is greater than a temperature change during the defrosting operation in a target space having a larger heat capacity. Therefore, by assigning a higher priority to indoor unit 2 placed in a target space having a smaller heat capacity, the amount of distribution of the outdoor unit capacity to indoor unit 2 placed in the target space where the temperature is likely to decrease during the defrosting operation becomes relatively larger. As a result, the comfort of the target space can be enhanced. In contrast, in a target space having a larger heat capacity, the temperature is less likely to decrease during the defrosting operation, and thus, the comfort is less affected by the small amount of distribution of the outdoor unit capacity.

(Process by Controller)

Figure 3:
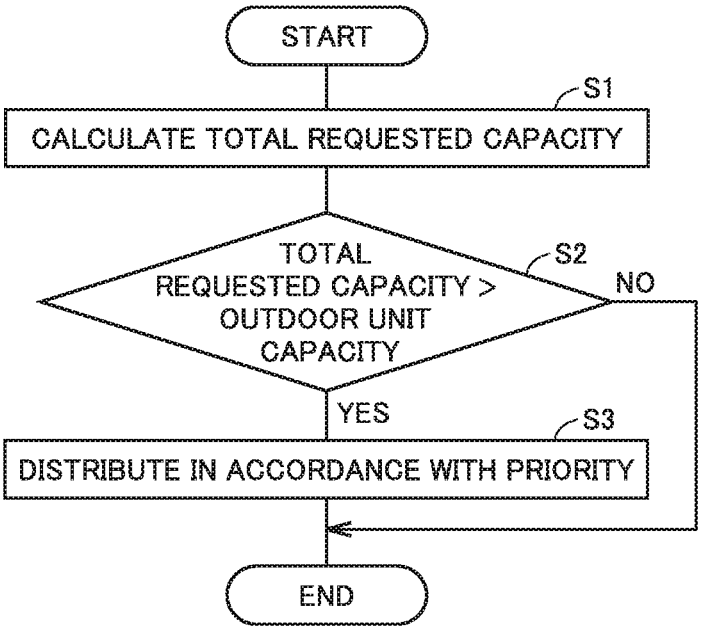
FIG. 3 is a flowchart showing a flow of a process by the controller shown in FIG. 1.

A flow of a process by controller 4 will be described with reference to FIG. 3. FIG. 3 is a flowchart showing a flow of a process by the controller.

First, in step S1, monitoring unit 41 calculates the total requested capacity based on the measured temperature and the set room temperature output from each of indoor units 2*a* to 2*c*. Next, in step S2, distribution processing unit 43 determines whether or not the total requested capacity is larger than the outdoor unit capacity. When the total requested capacity is not larger than the outdoor unit capacity (NO in step S2), controller 4 ends the process. When the total requested capacity is larger than the outdoor unit capacity (YES in step S2), distribution processing unit 43 distributes the outdoor unit capacity among indoor units 2*a* to 2*c* in accordance with the priorities set by priority setting unit 42 in step S3. Each of indoor units 2*a* to 2*c* performs a process corresponding to the change amount of the surface temperature of the object in the target space per unit time, in accordance with an instruction provided from distribution processing unit 43. The process corresponding to the change amount of the surface temperature per unit time includes a process for adjusting the degree of opening of flow rate adjusting valve 21, a process for adjusting the amount of air blown by fan 23, and the like. Specifically, of indoor units 2*a* to 2*c*, an indoor unit having a higher priority is operated more preferentially. For example, indoor unit 2 having a higher priority sets the degree of opening of flow rate adjusting valve 21 higher and/or the amount of air blown by fan 23 larger than indoor unit 2 having a lower priority. After step S3, controller 4 ends the process. Steps S1 to S3 shown in FIG. 3 are repeatedly performed at regular intervals.

(Process for Setting Priorities)

Figure 4:
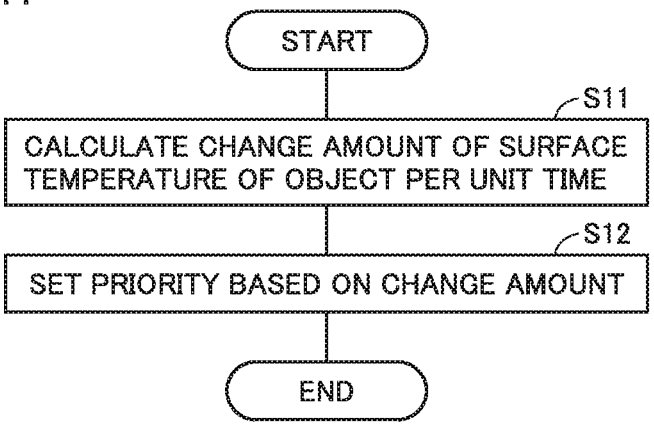
FIG. 4 is a flowchart showing a flow of a process for setting priorities in the first embodiment.

A flow of a process for setting the priorities will be described with reference to FIG. 4. FIG. 4 is a flowchart showing a flow of a process for setting the priorities in the first embodiment.

First, in step S11, priority setting unit 42 obtains the surface temperature information from indoor unit 2 only for a specified time period, and calculates the change amount of the surface temperature per unit time based on the obtained surface temperature information. Next, in step S12, priority setting unit 42 sets the priority of each of indoor units 2*a* to 2*c* based on the latest change amount calculated for each of indoor units 2*a* to 2*c*. Specifically, priority setting unit 42 assigns a higher priority to indoor unit 2 including surface temperature measuring device 24 that detects a surface temperature having a larger change amount.

Figures 5, 6:
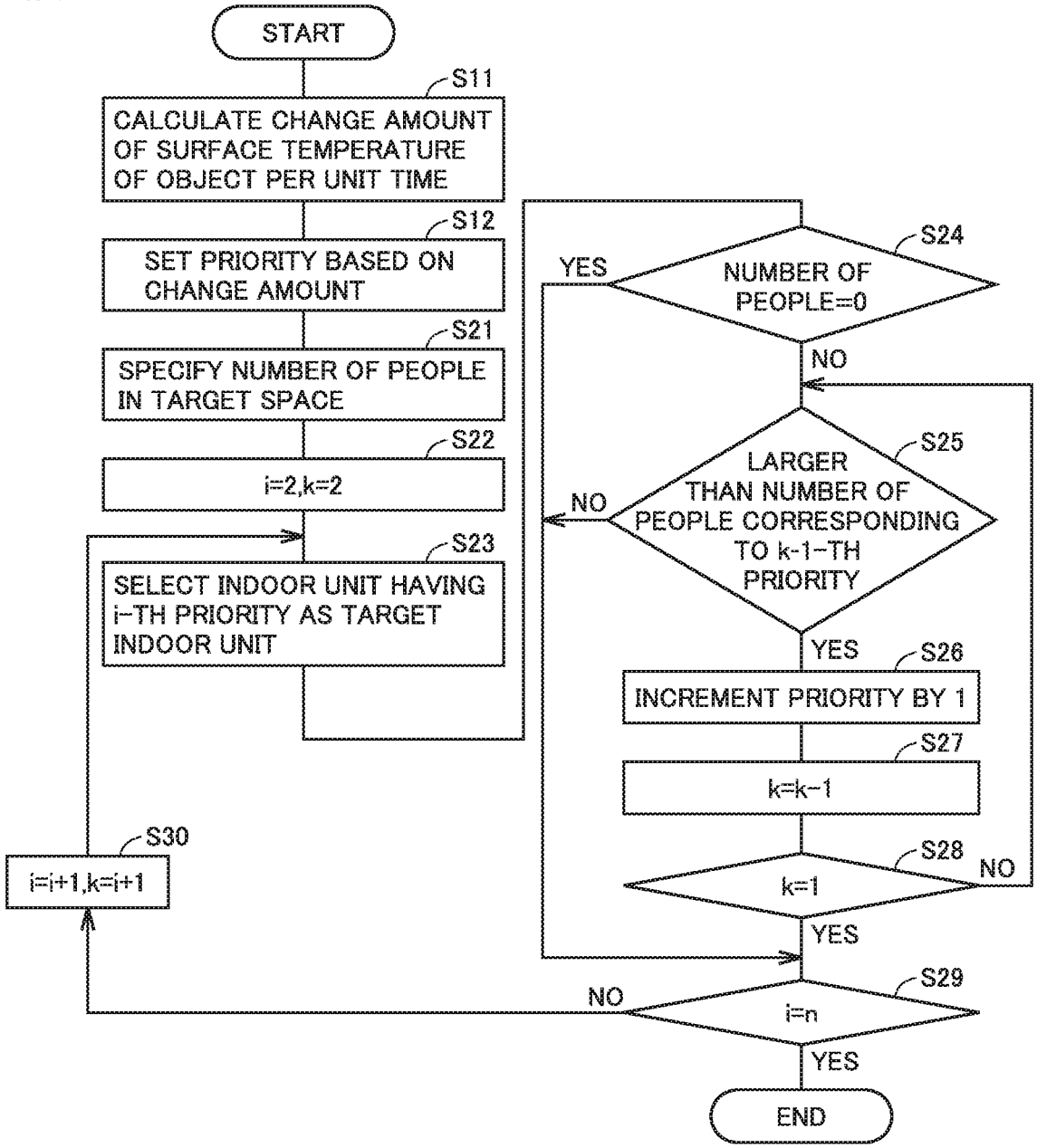
FIG. 5 shows an example of the priorities set in the first embodiment.
FIG. 6 is a flowchart showing a flow of a process for setting priorities in a second embodiment.

FIG. 5 shows an example of the priorities set in the first embodiment. FIG. 5 shows an example when a change amount, per unit time, of a surface temperature of an object in a target space where indoor unit 2*a* is placed is "0.1", a change amount, per unit time, of a surface temperature of an object in a target space where indoor unit 2*b* is placed is "0.5", and a change amount, per unit time, of a surface temperature of an object in a target space where indoor unit 2*c* is placed is "0.3". That is, a heat capacity of the target space where indoor unit 2*a* is placed>a heat capacity of the target space where indoor unit 2*c* is placed>a heat capacity of the target space where indoor unit 2*b* is placed. At this time, the priority of indoor unit 2*b* placed in the target space having the smallest heat capacity is set at "1", the priority of indoor unit 2*c* placed in the target space having the second largest heat capacity is set at "2", and the priority of indoor unit 2*a* placed in the target space having the largest heat capacity is set at "3".

Steps S11 and S12 shown in FIG. 4 are repeatedly performed at regular intervals. Alternatively, steps S11 and S12 may be performed when at least one indoor unit 2 is switched from an in-operation state to an operation stop state. The surface temperature of the object in the target space is likely to change when indoor unit 2 is switched from the in-operation state to the operation stop state. Therefore, after at least one indoor unit 2 is switched from the in-operation state to the operation stop state, priority setting unit 42 may obtain the surface temperature information from this indoor unit 2 and calculate the change amount of the surface temperature per unit time (step S11). Priority setting unit 42 obtains the surface temperature information only for a time period until a specified time elapses since indoor unit 2 was switched to the operation stop state, and calculates the change amount of the surface temperature per unit time based on a change of the surface temperature for this time period. As a result, the priorities can be easily set in accordance with the heat capacity of the target space.

Alternatively, steps S11 and S12 may be performed while outdoor unit 1 is performing the defrosting operation. While outdoor unit 1 is performing the defrosting operation, the surface temperature of the object in the target space is also likely to change because the heating operation of indoor unit 2 is suspended. As a result, the priorities can be easily set in accordance with the heat capacity of the target space.

(Advantage)

As described above, air conditioning system 100 includes a plurality of indoor units 2 configured to condition air in a target space, and outdoor unit 1 connected to the plurality of indoor units 2. Each of the plurality of indoor units 2 has surface temperature measuring device 24 configured to measure a surface temperature of an object in the target space. When a total of capacities requested by the plurality of indoor units 2 is larger than a capacity of the outdoor unit, the plurality of indoor units 2 perform a process corresponding to a change amount of the surface temperature per unit time. The process corresponding to the change amount of the surface temperature per unit time is, for example, at least one of a process for adjusting a degree of opening of flow rate adjusting valve 21 and a process for adjusting an amount of air blown by fan 23.

The change amount of the surface temperature of the object in the target space per unit time depends on the heat capacity of the target space. Therefore, according to the above-described configuration, the process corresponding to the heat capacity of the target space is performed. That is, the time and effort required for the user to preset the priorities as in the conventional art can be eliminated. As a result, the plurality of indoor units 2 can automatically perform the process corresponding to situations of the spaces where indoor units 2 are placed, when an insufficient capacity state of outdoor unit 1 arises.

Of the plurality of indoor units 2, indoor unit 2 placed in a target space having a larger change amount of the surface temperature per unit time is operated more preferentially.

With the above-described configuration, indoor unit 2 including surface temperature measuring device 24 that measures a surface temperature having a relatively large change amount per unit time is operated preferentially. The heat capacity of the target space Where this indoor unit 2 is placed is relatively small. Therefore, the temperature of the target space where this indoor unit 2 is placed can reach the set room temperature in a short time. As a result, the capacity requested by this indoor unit 2 decreases, and thus, the amount of distribution of the outdoor unit capacity to the other indoor units 2 can be increased at an early stage.

Furthermore, when the operation is switched from the heating operation to the defrosting operation and then is returned to the heating operation, the amount of distribution of the outdoor unit capacity to indoor unit 2 placed in the target space where the temperature is likely to decrease during the defrosting operation becomes relatively larger. As a result, the comfort of the target space is enhanced.

For example, indoor unit 2 having a higher priority sets the degree of opening of flow rate adjusting valve 21 higher and/or the amount of air blown by fan 23 larger than indoor unit 2 having a lower priority. As a result, the amount of distribution of the outdoor unit capacity to each indoor unit 2 is easily controlled.

Second Embodiment

An air conditioning system according to a second embodiment is configured similarly to air conditioning system 100 according to the first embodiment. However, the second embodiment is different from the first embodiment in that priority setting unit 42 sets the priorities in consideration of not only a change amount of a surface temperature per unit time but also the number of people present in a target space (number of people in a target space).

In the second embodiment, surface temperature measuring device 24 included in indoor unit 2 measures a distribution of a surface temperature of an object (including a human body) in a target space, and outputs surface temperature information indicating a heat distribution image that represents a measurement result. Surface temperature measuring device 24 is implemented by, for example, a thermography.

Similarly to the first embodiment, priority setting unit 42 calculates a change amount of the surface temperature of the object in the target space per unit time based on the surface temperature information output from indoor unit 2. Priority setting unit 42 may calculate a change amount of a surface temperature at a predetermined position (e.g., position of a wall, furniture or the like) of the heat distribution image indicated by the surface temperature information, or may calculate an average change amount, per unit time, of an overall surface temperature obtained from the heat distribution image. Alternatively, priority setting unit 42 may analyze the heat distribution image, to thereby make a distinction between a human body and an object other than the human body, and calculate a change amount of a surface temperature of the object other than the human body per unit time.

Furthermore, priority setting unit 42 analyzes the heat distribution image, to thereby make a distinction between a human body and an object other than the human body, and specify the number of people in the target space.

Priority setting unit 42 assigns a higher priority to indoor unit 2 placed in a target space that accommodates the larger number of people. Furthermore, when a plurality of target spaces accommodate the same number of people, priority setting unit 42 assigns a higher priority to indoor unit 2 including surface temperature measuring device 24 that measures a surface temperature having a larger change amount per unit time, fir the plurality of target spaces.

FIG. 6 is a flowchart showing a flow of a process for setting priorities in the second embodiment. Similarly to the first embodiment, priority setting unit 42 calculates the change amount of the surface temperature per unit time (step S11), and sets the priority of each of indoor units 2*a* to 2*c* based on the latest change amount calculated for each of indoor units 2*a* to 2*c* (step S12).

Next, in step S21, priority setting unit 42 analyzes the heat distribution image indicated by the surface temperature information obtained from each of indoor units 2*a* to 2*c*, to thereby specify the number of people in the target space of each of indoor units 2*a* to 2*c*.

Next, in step S22, priority setting unit 42 substitutes 2 into both two variables i and k. Each of variables i and k can take a positive integer equal to or less than the number n of indoor units 2. Variable i represents the priority set in step S12. Variable k represents a priority adjusted in consideration of the number of people in the target space.

After step S22, steps S23 to S28 described below are performed. Thereafter, in step S29, priority setting unit 42 determines whether or not i is equal to the number n (3 in the first embodiment) of indoor units 2. When i is not equal to n (NO in step S29), priority setting unit 42 substitutes into both i and k in step S30, and repeats steps S23 to S28. That is, steps S23 to S28 are repeatedly performed by sequentially substituting 2 to n into both i and k.

In step S23, priority setting unit 42 selects indoor unit 2 having an i-th priority as a target indoor unit. In step S24, priority setting unit 42 determines whether or not the number of people in a target space where the target indoor unit is placed is 0. When the number of people in the target space is not 0 (NO in step S24), priority setting unit 42 determines, in step S25, whether or not the number of people in the target space where the target indoor unit is placed is larger than the number of people in a target space where indoor unit 2 having a k−1-th priority is placed.

In FIG. 6, the number of people in the target space where indoor unit 2 having the k−1-th priority is placed is denoted as "number of people corresponding to k−1-th priority". When the number of people in the target space where the target indoor unit is placed is larger than the number of people in the target space where indoor unit 2 having the k−1-th priority is placed (YES in step S25), priority setting unit 42 increments the priority of the target indoor unit by 1 in step S26. That is, priority setting unit 42 resets the priority of the target indoor unit to a k−1-th priority, and resets the k−1-th priority of indoor unit 2 to a k-th priority. Next, priority setting unit 42 substitutes k−1 into k in step S27, and determines whether or not k is 1 in step S28. When k is not 1 (NO in step S28), the process is returned to step S25.

When the number of people in the target space where the target indoor unit is placed is 0 (YES in step S24), the process moves to step S29. When the number of people in the target space where the target indoor unit is placed is not larger than the number of people in the target space where indoor unit 2 having the k−1-th priority is placed (NO in step S25) and when k is 1 (YES in step S28), the process also moves to step S29. As described above, when determination of NO is made in step S29, priority setting unit 42 substitutes i+1 into both i and k in step S30 and repeats steps S23 to S28. When i=n (YES in step S29), the process ends.

Figures 7, 8:
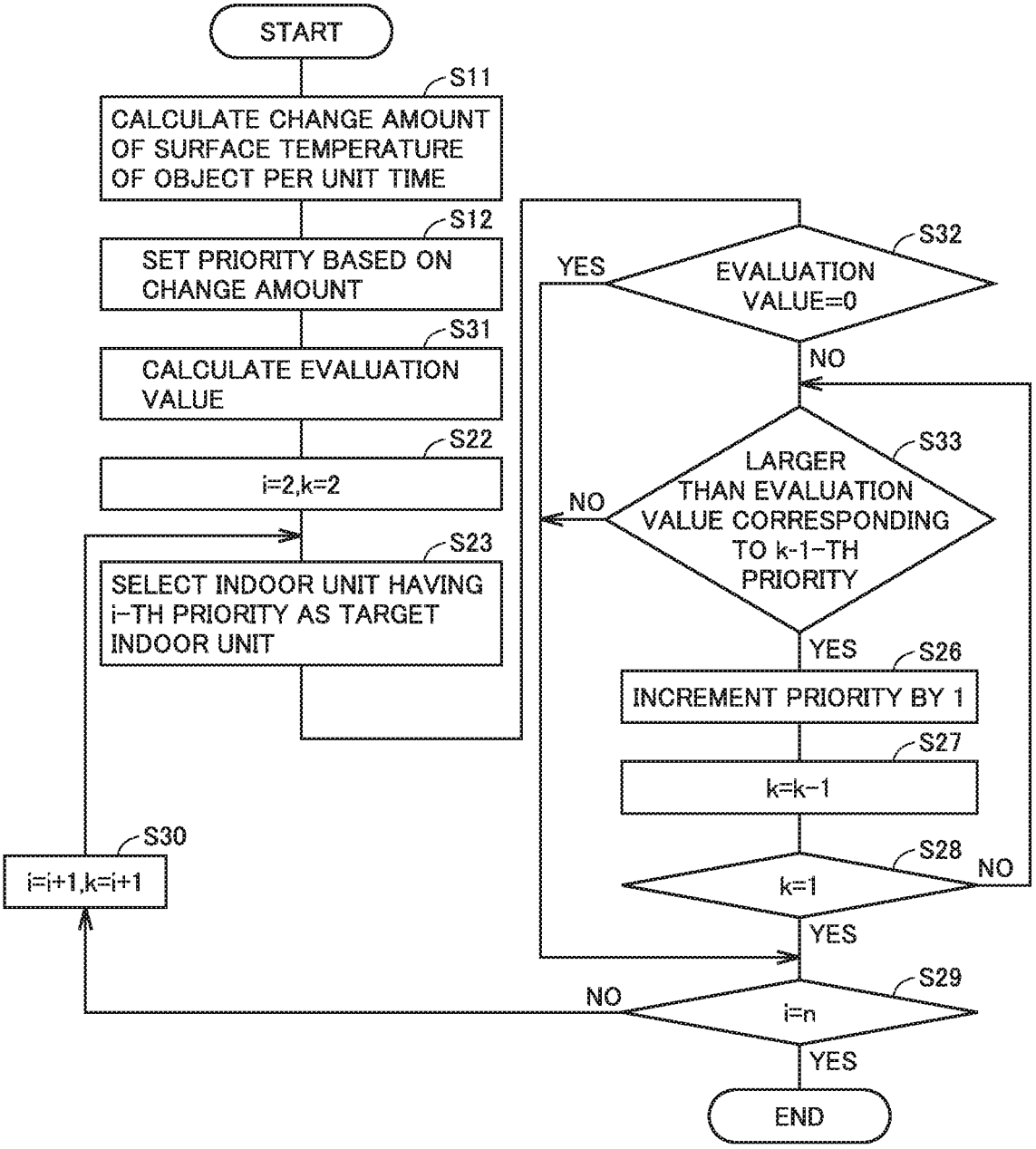
FIG. 7 shows an example of the priorities set in the second embodiment.
FIG. 8 is a flowchart showing a flow of a process for setting priorities in a third embodiment.

FIG. 7 shows an example of the priorities set in the second embodiment. FIG. 7 shows an example of the number of people in the target space, the change amount of the surface temperature of the object in the target space per unit time, and the set priority, for each of indoor units 2*a* to 2*c*. As shown in FIG. 7, a priority of indoor unit 2*a* placed in a target space in which the number of people is "5" is set higher than priorities of indoor units 2*b* and 2*c* placed in target spaces in which the number of people is "2". As a result, of the plurality of indoor units 2, indoor unit 2 placed in a target space that accommodates the larger number of people is operated more preferentially.

Furthermore, the priorities of indoor units 2*b* and 2*c* placed in the target spaces that accommodate the same number of people are set based on the change amount of the surface temperature per unit time, similarly to the first embodiment. That is, the priority of indoor unit 2*b* including surface temperature measuring device 24 that measures a surface temperature having a relatively large change amount per unit time is set higher than the priority of indoor unit 2*c*. As a result, of at least two indoor units 2 placed in target spaces that accommodate the same number of people, indoor unit 2 placed in a target space having a larger change amount of the surface temperature per unit time is operated more preferentially.

As described above, the number of people in the target space is specified based on the heat distribution image measured by surface temperature measuring device 24. Of the plurality of indoor units 2, indoor unit 2 placed in a target space that accommodates the larger number of people is operated more preferentially. Furthermore, of at least two indoor units 2 placed in target spaces that accommodate the same number of people, indoor unit 2 including surface temperature measuring device 24 that measures a surface temperature having a larger change amount per unit time is operated more preferentially. Thus, indoor unit 2 placed in the target space that accommodates the large number of people can be operated preferentially. As a result, the comfort of many people can be enhanced. Furthermore, when the number of people in the target space is the same, indoor unit 2 placed in a target space having a relatively small heat capacity can be operated preferentially. As a result, an effect similar to that of the first embodiment is produced.

Third Embodiment

An air conditioning system according to a third embodiment is a modification of the air conditioning system according to the second embodiment. In the second embodiment, the priorities are set in consideration of the number of people in the target space. However, in the third embodiment, the priorities are set in consideration of an evaluation value, instead of the number of people in the target space. The evaluation value is a product of the number of people in the target space and a sum of surface temperatures of the people in the target space.

FIG. 8 is a flowchart showing a flow of a process for setting priorities in the third embodiment. As shown in FIG. 8, the process for setting the priorities in the third embodiment is different from the process for setting the priorities in the second embodiment (see FIG. 6) in that steps S31, S32 and S33 are performed instead of steps S21, S24 and S25.

In step S31, priority setting unit 42 analyzes the heat distribution image indicated by the surface temperature information obtained from each of indoor units 2*a* to 2*c*, to thereby specify the number of people in the target space and calculate a sum of surface temperatures of the people in the target space. Priority setting unit 42 calculates a product of the specified number of people and the calculated sum of the surface temperatures as an evaluation value.

In step S32, priority setting unit 42 determines whether or not the evaluation value corresponding to the target indoor unit is 0.

When the evaluation value corresponding to the target indoor unit is not 0 (NO in step S32), priority setting unit 42 determines, in step S33, whether or not the evaluation value corresponding to the target indoor unit is larger than an evaluation value corresponding to the target space of indoor unit 2 having the k−1-th priority.

As described above, controller 4 specifies the number of people in the target space and specifies the surface temperatures of the people in the target space based on the heat distribution image measured by surface temperature measuring device 24. Of the plurality of indoor units 2, controller 4 assigns a higher priority to an indoor unit having a larger evaluation value that is the product of the number of people in the target space and the sum of the surface temperatures of the people in the target space. Thus, of the plurality of indoor units 2, indoor unit 2 placed in a target space having a larger evaluation value is operated more preferentially. Furthermore, of at least two indoor units 2 having the same evaluation value, indoor unit 2 including surface temperature measuring device 24 that measures a surface temperature having a larger change amount per unit time is operated more preferentially. That is, indoor unit 2 placed in a target space having a small heat capacity is operated preferentially. As a result, an effect similar to that of the first embodiment is produced.

Fourth Embodiment

An air conditioning system according to a fourth embodiment is a modification of the air conditioning system according to the second embodiment. In addition to a process similar to that of the second embodiment, priority setting unit 42 in the fourth embodiment performs a process for determining whether or not the target space is a server room, and assigning a highest priority to indoor unit 2 placed in the target space that is the server room.

Figure 9:
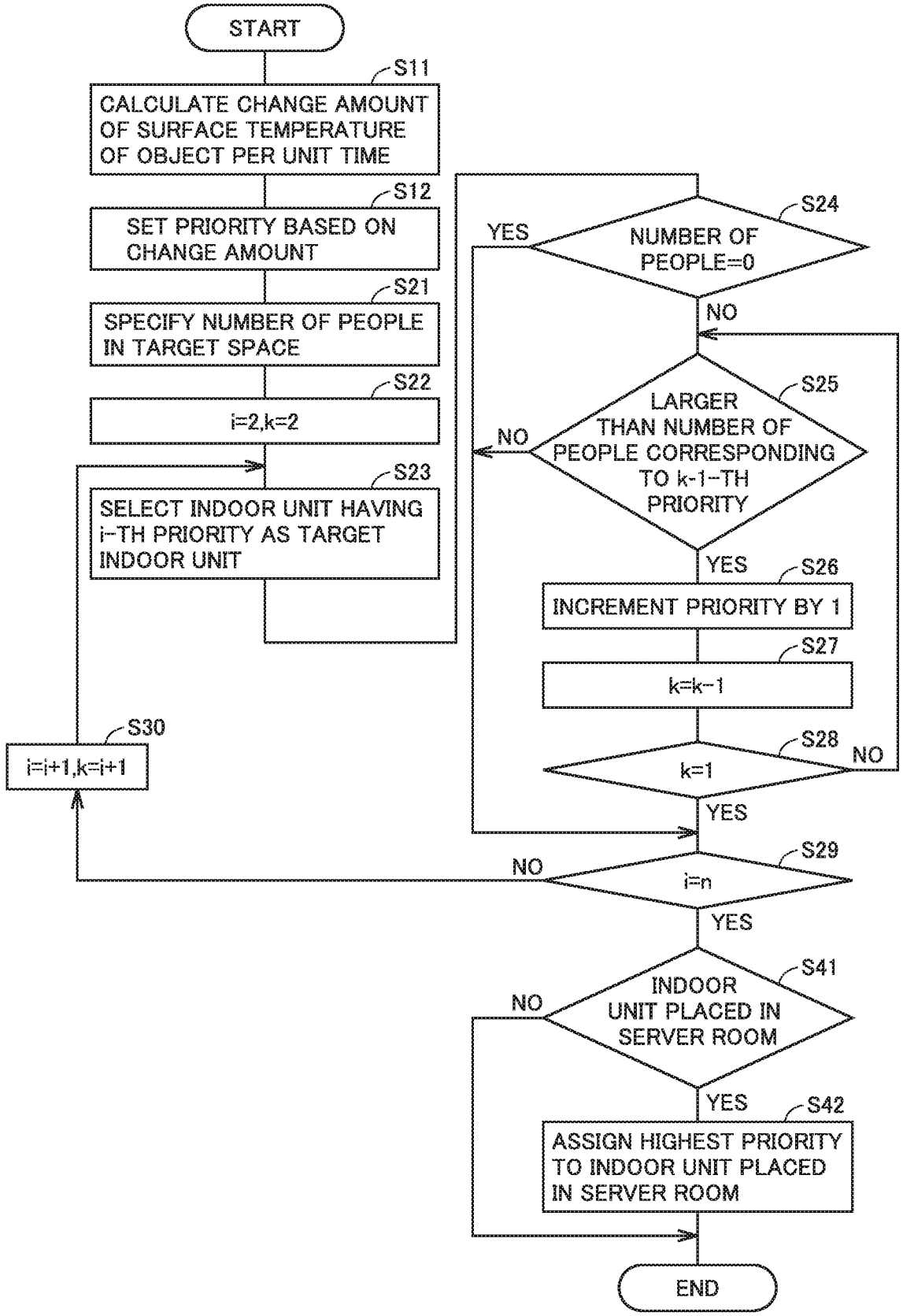
FIG. 9 is a flowchart showing a flow of a process for setting priorities in a fourth embodiment.

FIG. 9 is a flowchart showing a flow of a process for setting priorities in the fourth embodiment. As shown in FIG. 9, priority setting unit 42 performs steps S21 to S30 similarly to the second embodiment. When determination of YES is made in step S29, priority setting unit 42 analyzes the heat distribution image indicated by the surface temperature information obtained from each of indoor units 2*a* to 2*c*, to thereby determine whether or not there is indoor unit 2 placed in the target space that is the server room in step S41.

A plurality of server devices that generate heat are placed in the server room. Therefore, on the heat distribution image, priority setting unit 42 specifies objects (hereinafter, referred to as "heat generating elements") each having a surface temperature higher than a specified temperature and being located at the same position for more than a specified time period, and counts the number of the heat generating elements. When the number of the heat generating elements is larger than the specified number, priority setting unit 42 determines that the target space is the server room.

When there is indoor unit 2 placed in the target space that is the server room (YES in step S41), priority setting unit 42 assigns a highest priority to this indoor unit 2 in step S42. When there is no indoor unit 2 placed in the target space that is the server room (NO in step S41), the process ends.

As described above, of the plurality of indoor units 2, indoor unit 2 placed in the target space where more than the specified number of heat generating elements exist is operated more preferentially, the heat generating elements each having the surface temperature higher than the specified temperature and being located at the same position for more than the specified time period. Thus, even when the total requested capacity is larger than the outdoor unit capacity, indoor unit 2 placed in the server room can be operated most preferentially. As a result, an abnormal increase in temperature of the server room can be suppressed.

Fifth Embodiment

Figure 10:
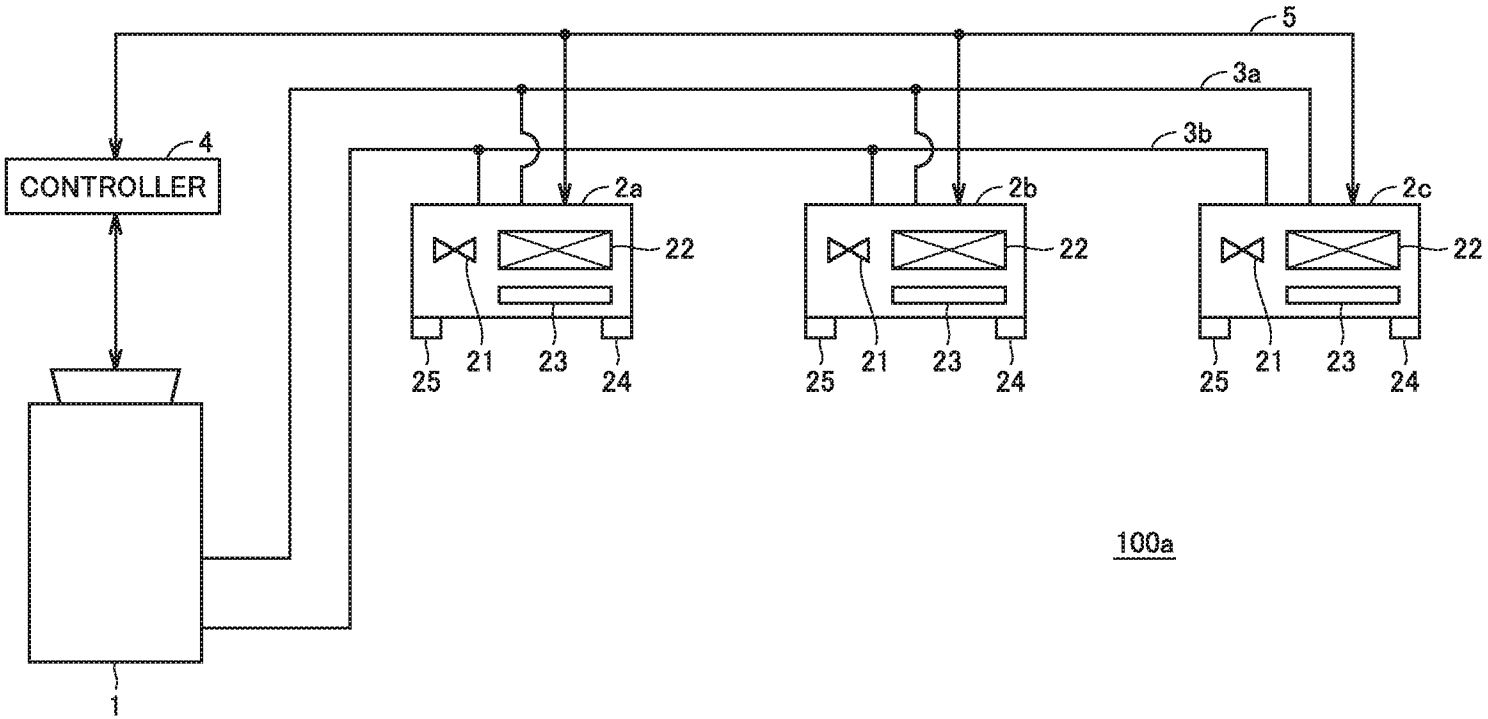
FIG. 10 shows a schematic configuration of an air conditioning system according to a fifth embodiment.

An air conditioning system according to a fifth embodiment is a modification of the air conditioning system according to any one of the second to fourth embodiments. FIG. 10 shows a schematic configuration of the air conditioning system according to the fifth embodiment. As shown in FIG. 10, an air conditioning system 100*a* according to the fifth embodiment is different from the air conditioning systems according to the second to fourth embodiments in that indoor unit 2 includes a camera 25. Camera 25 captures an image of a target space and outputs the obtained image to controller 4 through communication line 5.

Priority setting unit 42 in the fifth embodiment performs a process similar to the process in any one of the second to fourth embodiments. However, in step S21 (see FIGS. 6 and 9) or step S31 (see FIG. 8), priority setting unit 42 analyzes the image captured by camera 25, to thereby specify the number of people in the target space.

Furthermore, in step S41 (see FIG. 9), priority setting unit 42 analyzes the image captured by camera 25, to thereby determine whether or not there is indoor unit 2 placed in the target space that is a server room. A plurality of rectangular parallelepiped server devices are orderly placed in the server room. Therefore, priority setting unit 42 extracts an edge pixel group arranged in a rectangular shape from the image, and determines that the target space is the server room when the number, size, interval, arrangement or the like of the extracted edge pixel group falls within a reference range. The reference range is preset based on captured images of various server rooms.

The air conditioning system according to the fifth embodiment provides an effect similar to that in the second to fourth embodiments.

Sixth Embodiment

Figure 11:
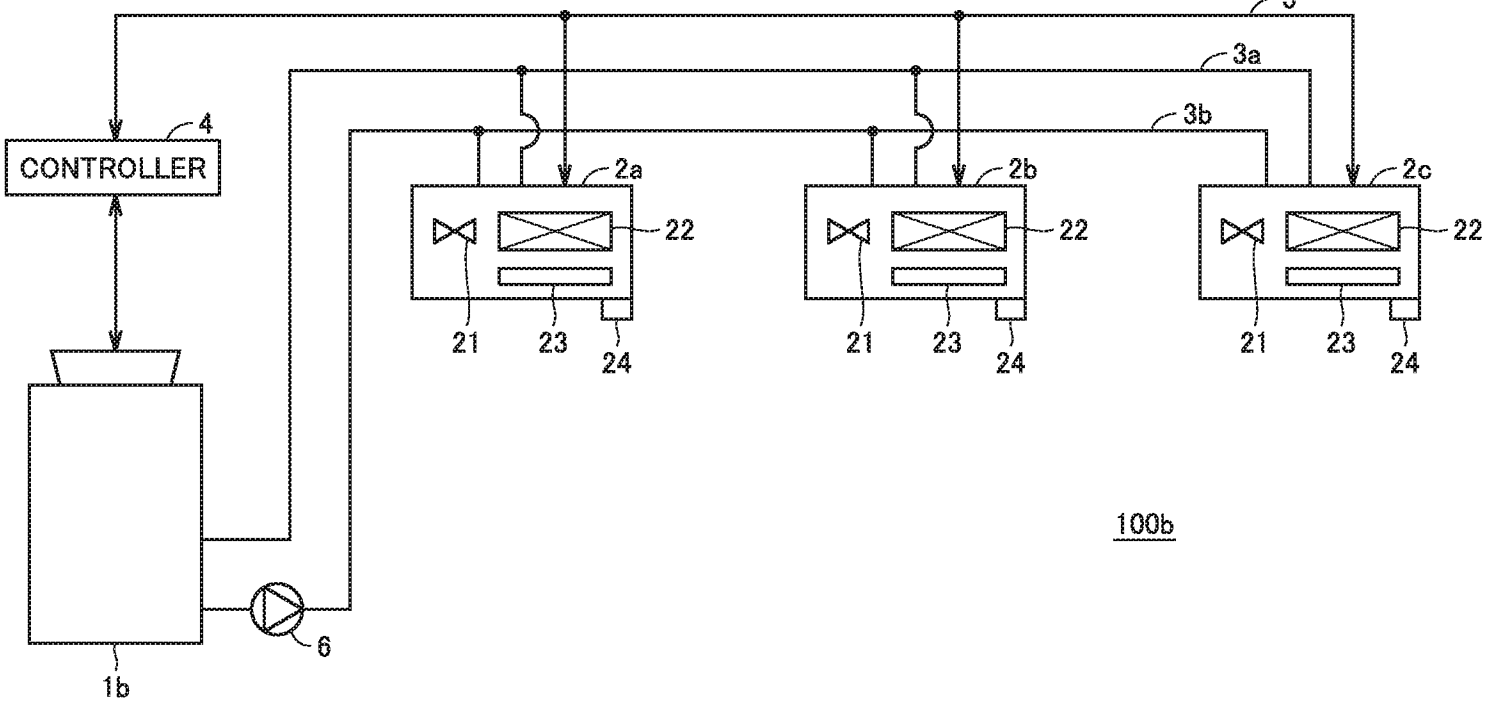
FIG. 11 shows a schematic configuration of an air conditioning system according to a sixth embodiment.

An air conditioning system according to a sixth embodiment is a modification of the air conditioning system according to any one of the first to fifth embodiments. FIG. 11 shows a schematic configuration of the air conditioning system according to the sixth embodiment. An air conditioning system 100*b* is different from the air conditioning systems according to the first to fifth embodiments in that air conditioning system 100*b* includes an outdoor unit 1*b* instead of outdoor unit 1, and further includes a pump 6.

In air conditioning system 100*b*, a heat medium different from the refrigerant is filled into a circulation circuit formed by outdoor unit 1*b*, pipe 3*a*, indoor unit 2, and pipe 3*b*. The heat medium circulates through the circulation circuit by pump 6. A liquid such as water, an antifreeze solution, a mixture of water and an antifreeze solution, or a mixture of water and an additive having a high anticorrosion effect is used as the heat medium different from the refrigerant.

Outdoor unit 1*b* performs heat exchange with the heat medium flowing through the circulation circuit. For example, outdoor unit 1*b* includes a first heat exchanger configured to perform heat exchange between the outdoor air and the refrigerant, a second heat exchanger configured to perform heat exchange between the refrigerant and the heat medium flowing through the circulation circuit, and a refrigerant pipe that connects the first heat exchanger and the second heat exchanger. A single refrigerant such as R-22, R-134a or R32, a near-azeotropic refrigerant mixture such as R-410A or R-404A, a non-azeotropic refrigerant mixture such as R-407C, a refrigerant including a double bond in a chemical formula and having a relatively small global warming potential value such as $CF_3CF{=}CH_2$, or a mixture thereof, or a natural refrigerant such as $CO_2$ or propane is, for example, used as the refrigerant.

The time required for heat transfer from the outdoor unit to the indoor units is longer when the heat medium (e.g., water) different from the refrigerant is circulated between the outdoor unit and the indoor units than when the refrigerant is circulated between the outdoor unit and the indoor units. Therefore, once the total requested capacity exceeds the outdoor unit capacity, for example, at the time of simultaneous startup of the plurality of indoor units or at the time of return from the defrosting operation to the heating operation, the time for the total requested capacity to fall below the outdoor unit capacity becomes longer. Therefore, the effect provided by setting the priorities in consideration of the heat capacity is strengthened.

Seventh Embodiment

An air conditioning system according to a seventh embodiment is a modification of the air conditioning system according to the fifth embodiment shown in FIG. 10. In the air conditioning system according to the seventh embodiment, indoor unit 2 does not need to include surface temperature measuring device 24.

Figure 12:
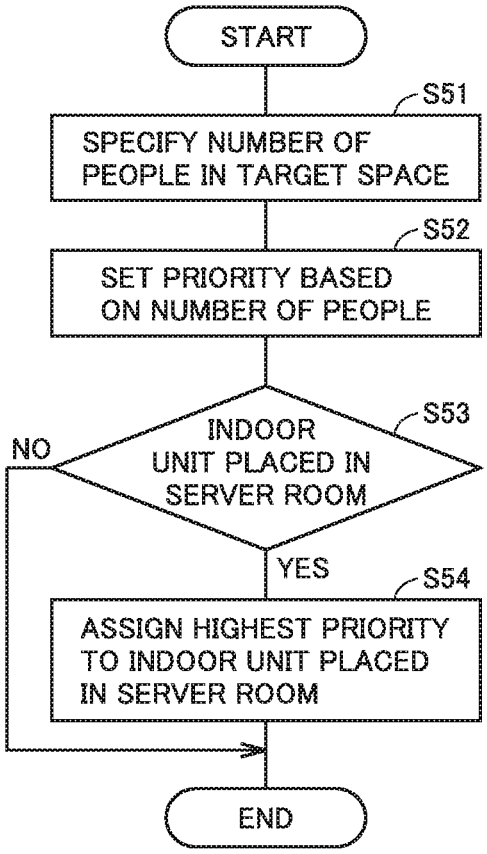
FIG. 12 is a flowchart showing a flow of a process for setting priorities in a seventh embodiment.

FIG. 12 is a flowchart showing a flow of a process for setting priorities in the seventh embodiment. First, in step S51, priority setting unit 42 analyzes the image captured by camera 25, to thereby specify the number of people in the target space. Next, in step S52, priority setting unit 42 sets a priority of each of indoor units 2*a* to 2*c*, based on the number of people in the target space. Specifically, priority setting unit 42 assigns a higher priority to an indoor unit placed in a target space that accommodates the larger number of people.

Next, in step S53, priority setting unit 42 analyzes the image captured by camera 25, to thereby determine whether or not there is indoor unit 2 placed in the target space that is the server room.

When there is indoor unit 2 placed in the target space that is the server room (YES in step S53), priority setting unit 42 assigns a highest priority to this indoor unit 2 in step S54. Thus, of the plurality of indoor units 2, indoor unit 2 placed in the target space that is the server room is operated more preferentially. When there is no indoor unit 2 placed in the target space that is the server room (NO in step S53), the process ends.

Priority setting unit 42 may omit steps S51 and S52 and perform steps S53 and S54 after arbitrarily setting the priorities. That is, priority setting unit 42 may assign a highest priority to indoor unit 2 placed in the target space that is the server room, based on the image captured by camera 25, and arbitrarily set the priorities of indoor units 2 placed in the target spaces other than the server room.

Eighth Embodiment

An air conditioning system according to an eighth embodiment is a modification of the air conditioning system according to any one of the first to seventh embodiments. When indoor unit 2 cannot operate normally due to some kind of error, indoor unit 2 transmits an error notification to controller 4 through communication line 5.

Controller 4 determines indoor unit 2 having transmitted the error notification as broken indoor unit 2, and does not set a priority for broken indoor unit 2 and sets the amount of distribution of the outdoor unit capacity at 0 for broken indoor unit 2. Thus, of the plurality of indoor units 2, broken indoor unit 2 does not operate. As a result, the outdoor unit capacity can be efficiently distributed to non-broken indoor units 2.

It should be understood that the embodiments disclosed herein are illustrative and non-restrictive in every respect. The scope of the present invention is defined by the terms of the claims, rather than the description of the embodiments above, and is intended to include any modifications within the scope and meaning equivalent to the terms of the claims.

REFERENCE SIGNS LIST

1, 1*b* outdoor unit; 2, 2*a*, 2*b*, 2*c* indoor unit; 3*a*, 3*b* pipe; 4 controller; 5 communication line; 6 pump; 21 flow rate adjusting valve; 22 indoor heat exchanger; 23 fan; 24 surface temperature measuring device; 25 camera; 41 monitoring unit; 42 priority setting unit; 43 distribution processing unit; 100, 100*a*, 100*b* air conditioning system.

The invention claimed is:

1. An air conditioning system comprising:

a plurality of indoor units each configured to condition air in a target space; and an outdoor unit connected to the plurality of indoor units, wherein:

each of the plurality of indoor units has a surface temperature measuring device configured to measure a surface temperature of an object in the target space, when a total of capacities requested by the plurality of indoor units is larger than a capacity of the outdoor unit, each of the plurality of indoor units performs a process corresponding to a change amount of the surface temperature per unit time, the object includes a human body, the surface temperature measuring device is configured to measure a distribution of the surface temperature in the target space, by analyzing the distribution, an object other than the human body is distinguished from the human body, and a change amount of a surface temperature of the object other than the human body per unit time is calculated, the number of people in the target space is specified and surface temperatures of people in the target space are specified based on the distribution of the surface temperature, of the plurality of indoor units, an indoor unit having a larger product of the number of people in the target space and a sum of the surface temperatures of the people in the target space is operated more preferentially, and of at least two indoor units having the same product, an indoor unit placed in a target space having a larger change amount of the surface temperature of the object other than the human body per unit time is operated more preferentially.

2. The air conditioning system according to claim 1, wherein of the plurality of indoor units, a broken indoor unit does not operate.

3. The air conditioning system according to claim 1 further comprising a pump configured to deliver a liquid serving as a heat medium from the outdoor unit to the plurality of indoor units.

4. The air conditioning system according to claim 1, wherein each of the plurality of indoor units further includes:

a heat exchanger configured to perform heat exchange between a heat medium discharged from the outdoor unit and the air in the target space; and a flow rate adjusting valve configured to adjust a flow rate of the heat medium from the outdoor unit to the heat exchanger, and the process is a process for adjusting a degree of opening of the flow rate adjusting valve.

5. The air conditioning system according to claim 1, wherein each of the plurality of indoor units further includes:

a heat exchanger configured to perform heat exchange between a heat medium discharged from the outdoor unit and the air in the target space; and a fan configured to deliver the air in the target space to the heat exchanger, and the process is a process for adjusting an amount of air blown by the fan.

* * * * *